US005676875A

United States Patent [19]

Kelley

[11] Patent Number: 5,676,875

[45] Date of Patent: Oct. 14, 1997

[54] INSULATED ICE TRAY SYSTEM

[76] Inventor: John F. Kelley, 36 Crest Dr., Mahopac, N.Y. 10541

[21] Appl. No.: 608,620

[22] Filed: Mar. 1, 1996

[51] Int. Cl.[6] ..... B28B 7/26

[52] U.S. Cl. ..... 244/117; 249/120

[58] Field of Search ..... 249/111, 119, 249/120, 133, 117

[56] References Cited

U.S. PATENT DOCUMENTS

| | | | |
|---|---|---|---|
| 3,480,251 | 11/1969 | Pietrzak | 249/119 |
| 4,789,130 | 12/1988 | Stich et al. | 249/120 |
| 4,815,691 | 3/1989 | Cooley | 249/120 |
| 5,012,655 | 5/1991 | Chatterton | 249/120 |
| 5,044,600 | 9/1991 | Shannon | 249/120 |
| 5,364,063 | 11/1994 | Nishimura et al. | 249/119 |

FOREIGN PATENT DOCUMENTS

| | | | |
|---|---|---|---|
| 952177 | 11/1956 | Netherlands | 249/119 |

*Primary Examiner*—William E. Tapolcai

[57] ABSTRACT

A system for effecting slow freezing of ice within a freezer. The inventive device includes an insulated enclosure receiving an ice tray therewithin such that a rate of thermal transfer of heat from the water within the tray is slowed to allow the escape of gases from the water resulting in improved clarity of the ice.

1 Claim, 3 Drawing Sheets

INSULATED ICE TRAY SYSTEM

BACKGROUND OF THE INVENTION

1. Field of the Invention

The present invention relates to ice forming structures and more particularly pertains to an insulated ice tray system for effecting slow freezing of ice within a freezer.

2. Description of the Prior Art

The use of ice forming structures is known in the prior art. More specifically, ice forming structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art ice forming structures include U.S. Pat. No. 3,642,162; U.S. Pat. No. 3,443,785; U.S. Pat. No. 5,240,150; U.S. Pat. No. 3,747,810; U.S. Design Pat. No. 309,905; and U.S. Design Pat. No. 318,281.

While these devices fulfill their respective, particular objectives and requirements, the aforementioned patents do not disclose a insulated ice tray system for an insulated ice tray system for effecting slow freezing of ice within a freezer which includes an insulated enclosure receiving an ice tray therewithin such that a rate of thermal transfer of heat from water within the tray is slowed to allow the escape of gases from the water resulting in improved clarity of the ice.

In these respects, the insulated ice tray system according to the present invention substantially departs from the conventional concepts and designs of the prior art, and in so doing provides an apparatus primarily developed for the purpose of effecting slow freezing of ice within a freezer.

SUMMARY OF THE INVENTION

In view of the foregoing disadvantages inherent in the known types of ice forming structures now present in the prior art, the present invention provides a new insulated ice tray system construction wherein the same can be utilized for effecting slow freezing of ice within a freezer. As such, the general purpose of the present invention, which will be described subsequently in greater detail, is to provide a new insulated ice tray system apparatus and method which has many of the advantages of the ice forming structures mentioned heretofore and many novel features that result in a insulated ice tray system which is not anticipated, rendered obvious, suggested, or even implied by any of the prior an ice forming structures, either alone or in any combination thereof.

To attain this, the present invention generally comprises a system for effecting slow freezing of ice within a freezer. The inventive device includes an insulated enclosure receiving an ice tray therewithin such that a rate of thermal transfer of heat from the water within the tray is slowed to allow the escape of gases from the water resulting in improved clarity of the ice.

There has thus been outlined rather broadly, the more important features of the invention in order that the detailed description thereof that follows may be better understood, and in order that the present contribution to the an may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new insulated ice tray system apparatus and method which has many of the advantages of the ice forming structures mentioned heretofore and many novel features that result in a insulated ice tray system which is not anticipated, rendered obvious, suggested, or even implied by any of the prior art tool guides, either alone or in any combination thereof.

It is another object of the present invention to provide a new insulated ice tray system which may be easily and efficiently manufactured and marketed.

It is a further object of the present invention to provide a new insulated ice tray system which is of a durable and reliable construction.

An even further object of the present invention is to provide a new insulated ice tray system which is susceptible of a low cost of manufacture with regard to both materials and labor, and which accordingly is then susceptible of low prices of sale to the consuming public, thereby making such insulated ice tray systems economically available to the buying public.

Still yet another object of the present invention is to provide a new insulated ice tray system which provides in the apparatuses and methods of the prior art some of the advantages thereof, while simultaneously overcoming some of the disadvantages normally associated therewith.

Still another object of the present invention is to provide a new insulated ice tray system for effecting slow freezing of ice within a freezer.

Yet another object of the present invention is to provide a new insulated ice tray system which includes an insulated enclosure receiving an ice tray therewithin such that a rate of thermal transfer of heat from water within the tray is slowed to allow the escape of gases from the water resulting in improved clarity of the ice.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
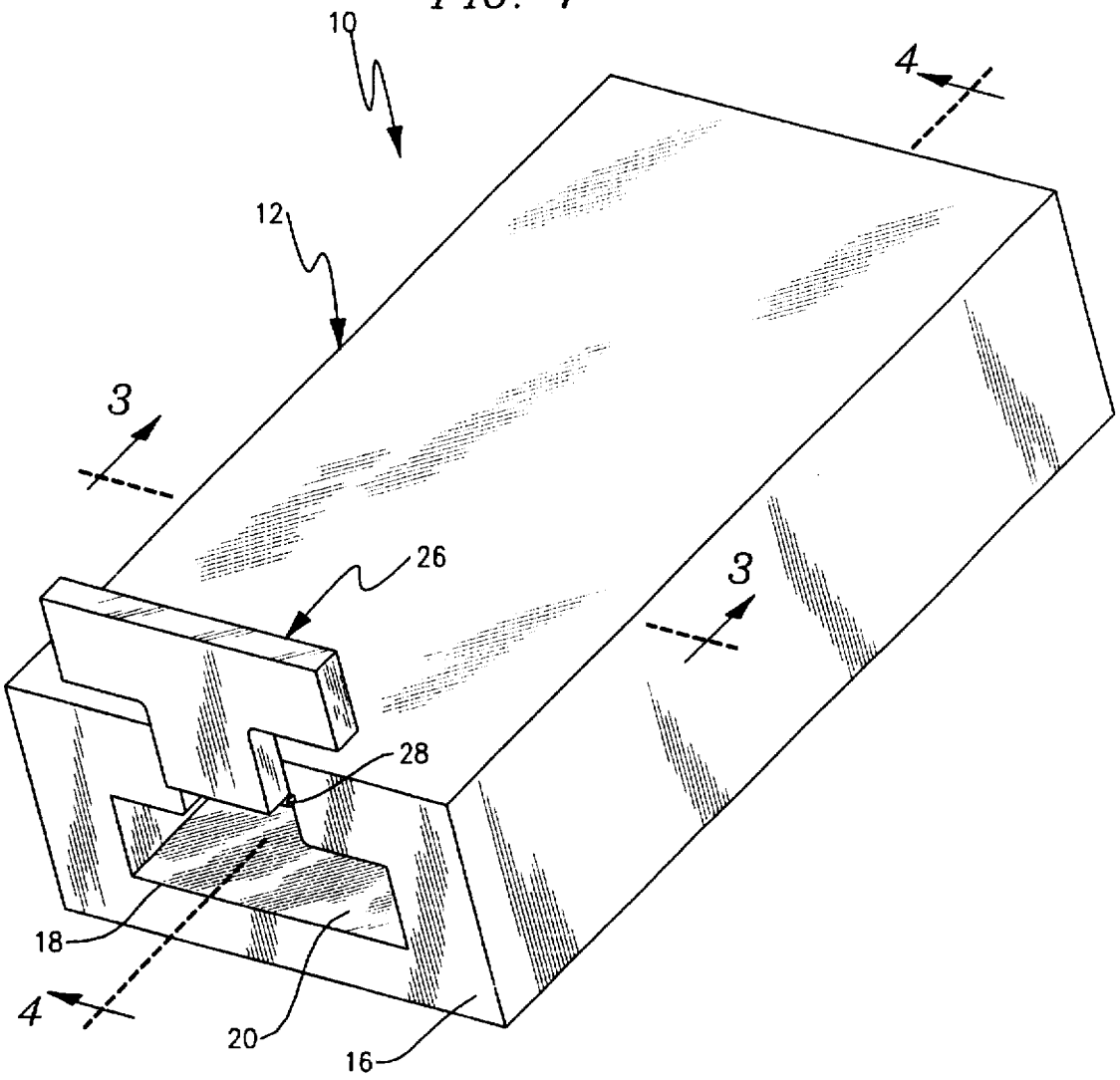
FIG. 1 is an isometric illustration of an insulated ice tray system according to the present invention.

With reference now to the drawings, and in particular to FIGS. 1–4 thereof, a new insulated ice tray system embodying the principles and concepts of the present invention and generally designated by the reference numeral 10 will be described.

Figure 2:
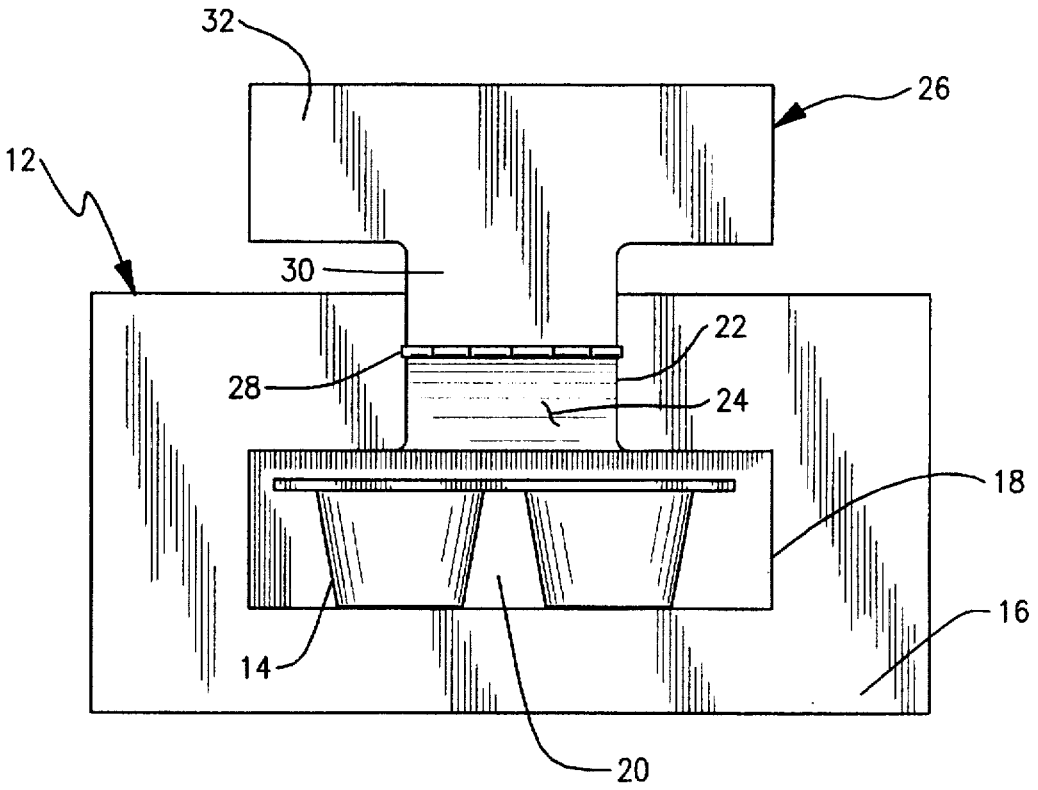
FIG. 2 is a front elevation view thereof.
Figure 4:
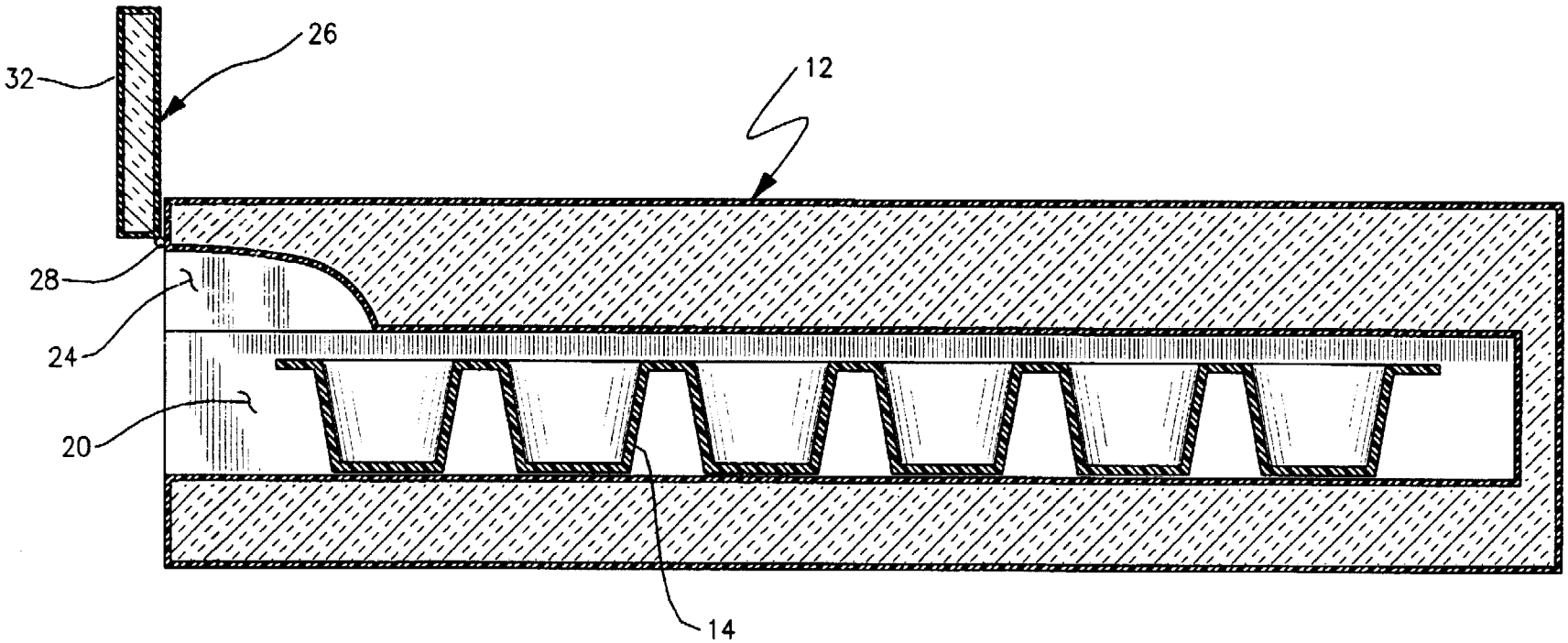
FIG. 4 is a cross sectional view taken along line 4—4 of FIG. 1.

More specifically, it will be noted that the insulated ice tray system 10 comprises an insulated enclosure 12 having an ice cube tray 14 positioned therein substantially as shown in FIGS. 2 and 4 of the drawings. By this structure, water can be positioned within the ice cube tray 14, with the entire device being subsequently positioned into a cold environment such as a freezer, whereby a rate of thermal transfer of heat from the water in the ice tray is reduced to allow the escape or dissolution of gases from the water resulting in an improved clarity of the ice subsequently formed within the tray.

As best illustrated in FIGS. 1 and 2 it can be shown that the insulated enclosure 12 is shaped so as to define a front wall 16 having an entrance aperture 18 directed therethrough permitting access into a hollow interior 20 of the insulated enclosure 12 within which the ice cube tray 14 is positioned. As shown in FIG. 4, the insulated enclosure 12 is further shaped so as to define a gripping aperture 22 directed through the front wall 16 thereof and into communication with a gripping cavity 24 positioned above and in contiguous communication with the hollow interior 20. The gripping aperture 22 and the gripping cavity 24 permit an individual to project one or more digits of a human hand into the hollow interior so as to grasp an uppermost portion of the ice cube tray 14 as best illustrated in FIG. 4. In other words, an individual can extend an index finger of a human hand through the gripping aperture 22 and into the gripping cavity 24 so as to engage an upper surface of the ice cube tray 14, with a thumb of the human hand extending through the entrance aperture 18 and into the hollow interior 20 so as to grasp a further portion of the ice cube tray 14 to effect removal thereof from the hollow interior 20.

With continuing reference to FIGS. 1 and 2, it can be shown that the insulated enclosure 12 further comprises an insulated closure member 26 pivotally mounted to the front wall 16 by a hinge 28 interposed therebetween. The insulated closure member 26, as best illustrated in FIG. 2, includes a gripping aperture closure panel 30 mounted to the hinge for pivotal positioning into the gripping aperture 22. An entrance aperture closure panel 32 is coupled to a free distal end of the gripping aperture closure panel 30 and positioned for pivotal movement into the entrance aperture 18. By this structure, the insulate closure member 26 can be pivotally positioned into the entrance aperture 18 and griping aperture 22 so as to close the hollow interior 20 from communication with ambient exterior air.

Figure 3:
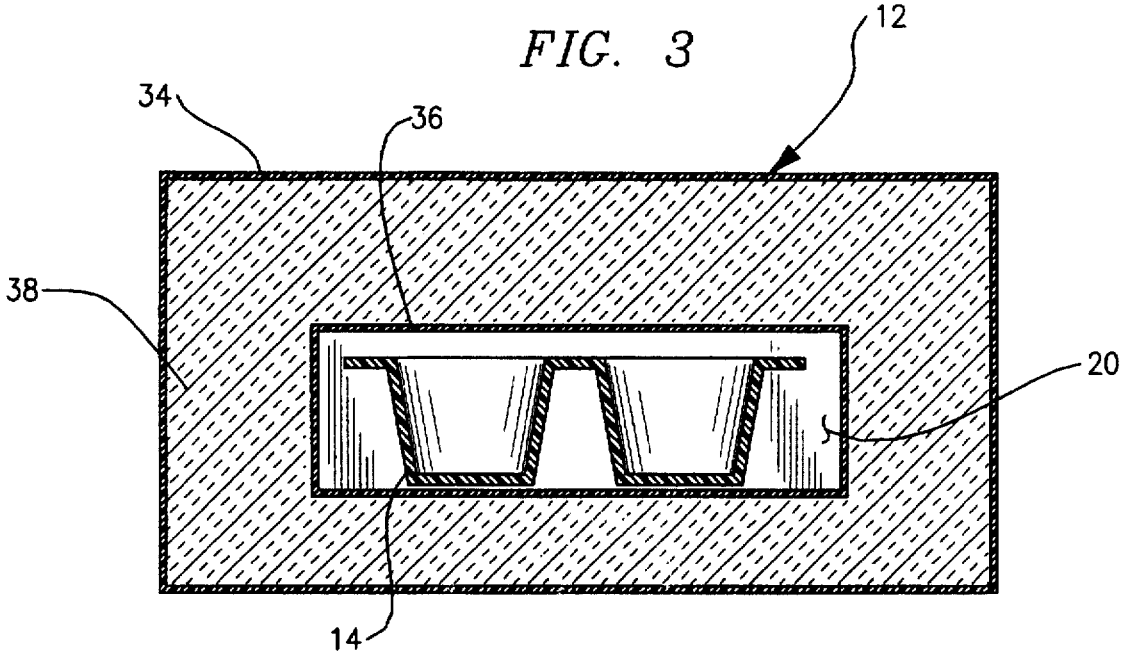
FIG. 3 is a cross sectional view taken along line 3—3 of FIG. 1.

Referring now to FIG. 3, it can be shown that the insulated enclosure 12 is preferably comprised of a substantially rigid exterior shell 34 having an interior shell 36 extending in a substantially spaced and parallel orientation therewithin. Insulation material 38 is interposed between the exterior shell 34 and the interior shell 36 so as to reduce a rate of thermal transfer from the hollow interior 20 to ambient air surrounding the insulated enclosure 12. By this structure, water positioned within the ice cube tray 14 is slowly frozen when the entire device is positioned within a freezing environment such that gases can escape from the water to result in improved clarity of the ice formed therein.

As best illustrated in FIG. 4, it can be shown that the ice cube tray 14 of the present invention 10 preferably comprises an unlabeled planar member having a plurality of apertures directed therethrough and a plurality of ice cube forming cups extending downwardly from the planar member and into contiguous communication with the respective apertures thereof. The ice cube tray 14 thus allows ice cubes to be formed within each of the individual cups thereof.

In use, the insulated ice tray system 10 according to the present invention can be easily utilized for effecting slow freezing of ice within a freezer. The present invention 10, because of the insulation material 38 of the insulated enclosure 12 and insulated closure member 26 covering both the griping aperture 22 and the entrance aperture 18, allows for slow freezing of water within the ice cube tray 14 to permit an escape of gases therefrom resulting in improved clarity of the ice.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An insulated ice tray system comprising:

an insulated enclosure being shaped so as to define a front wall having an entrance aperture directed therethrough and permitting access into a hollow interior of the insulated enclosure, the insulated enclosure further being shaped so as to define a gripping aperture directed through the front wall thereof and into communication with a gripping cavity positioned above and in contiguous communication with the hollow interior such that the gripping aperture and the gripping cavity permitting an individual to project at least one digit of human hand into the hollow interior, the insulated enclosure having a substantially rigid exterior shell having an interior shell extending in a substantially spaced and parallel orientation therewithin, an insulation material interposed between the exterior shell and the interior shell so as to reduce the rate of thermal transfer from the hollow interior to ambient air surrounding the insulated enclosure;

an ice cube tray positioned within the insulated enclosure, the ice cube tray having a planar member with a plurality of apertures directed therethrough, the planar member having a plurality of ice cube forming cups extending downwardly therefrom and into contiguous communication with the respective apertures thereof, the ice cube tray having an upper most portion capable of being grasped by the one digit of human positioned into the hollow cavity of the insulated enclosure, a thumb of the human hand being extendable through the entrance aperture and into the hollow interior to permit grasping of a further portion of the ice cube tray to permit removal of the ice cube tray from the hollow interior of the insulated enclosure; and an insulated closure member pivotally mounted to the front wall of the insulated enclosure, the insulated closure member having a gripping aperture closure panel pivotally mounted to the front wall of the insulated enclosure for pivotal positioning into the gripping aperture thereof, an entrance aperture closure panel coupling a free distal end of the gripping aperture closure panel and positioned for pivotal movement into the entrance aperture of the front wall of the insulated enclosure, the insulated closure member being positioned in a closed orientation when the ice cube tray with water being positioned within the insulated enclosure for allowing positioning of the insulated enclosure into a cold environment for the formation of ice cubes within the ice cube tray.

* * * * *